United States Patent [19]

Kendregan et al.

[11] Patent Number: 5,028,206

[45] Date of Patent: Jul. 2, 1991

[54] ILLUMINATED CEILING FAN

[76] Inventors: David S. Kendregan; James C. Crouch, both of Fort Wayne, Ind.

[21] Appl. No.: 502,444

[22] Filed: Mar. 30, 1990

[51] Int. Cl.[5] ..... F21V 33/00

[52] U.S. Cl. ..... 416/5; 362/96

[58] Field of Search ..... 416/5, 62; 362/96, 216, 362/260, 294

[56] References Cited

U.S. PATENT DOCUMENTS

| | | | |
|---|---|---|---|
| D. 298,454 | 11/1988 | Clyde-Mason | D23/385 |
| 1,747,433 | 2/1930 | Genest | 416/5 |
| 2,509,109 | 7/1949 | Pretzer | 362/216 |
| 2,547,896 | 4/1951 | Wellen | 416/5 |
| 2,581,185 | 1/1952 | Gordon | 416/5 |
| 3,701,498 | 10/1972 | Ferrara | 416/5 X |
| 4,342,073 | 7/1982 | Ranten | 362/294 |
| 4,356,535 | 10/1982 | Chu | 362/294 X |
| 4,382,400 | 5/1983 | Stutzman | 362/294 X |
| 4,831,505 | 5/1989 | Van Norman | 362/216 |

*Primary Examiner*—Edward K. Look
*Assistant Examiner*—James A. Larson
*Attorney, Agent, or Firm*—Jeffers, Hoffman & Niewyk

[57] ABSTRACT

A fan having a plurality of rotating blades and a motor to rotate the blades. A source of illumination is secured to the outer periphery of the rotating blades for rotation therewith, thus defining the shape of each blade when the source of illumination is energized. Further decorative lighting may also be provided for the stationary parts of the fan.

12 Claims, 4 Drawing Sheets

ILLUMINATED CEILING FAN

BACKGROUND OF THE INVENTION

The present invention relates generally to fans, and more particularly to illuminated fans. The invention is particularly suitable for use as a ceiling fan.

Conventional fans such as ceiling fans are well known in the prior art for circulating air in rooms of buildings. These fans are generally equipped with a motor having a rotor to which are connected radially extending blades. It is further known in the art to combine a ceiling fan with a light source so that the combined unit serves as both a fan and light fixture for illuminating the room. A typical combined ceiling fan and lighting fixture includes a central light source located beneath the motor.

No fans have been provided wherein the purpose of the light is for aesthetic effect only.

It is desired to provide an illuminated fan which is aesthetically pleasing and which is suitable for providing both ventilation and a pleasing aesthetic effect, such as in restaurants and nightclubs.

SUMMARY OF THE INVENTION

The present invention provides a fan having a plurality of rotating blades and wherein a source of illumination is secured to at least one of the blades for rotation therewith. More specifically, the present invention provides a fan having a plurality of rotating blades wherein a source of illumination such as a neon tube is mounted around the periphery of each blade, thus defining its shape when the light source is energized. Further decorative lighting may also be provided for the stationary part of the fan.

One advantage of the fan of the present invention is that the illuminated periphery of the moving blades is aesthetically pleasing, especially in rooms having limited light such as nightclubs and restaurants.

Another advantage of the fan of the present invention is that the periphery of the blades of the fan are conspicuous in a dark environment thus decreasing the possibility of injury due to unintentional contact with the moving blades.

Still another advantage of the fan of the present invention is that it provides air circulation and is ornamental.

Yet still a further advantage of the present invention is that a light source is mounted directly to the blades to provide a single compact unit.

The present invention, in one form thereof, comprises a fan having a plurality of rotating blades and a motor for rotating the blades. A source of illumination is secured to at least one of the plurality of rotating blades and is rotated therewith.

The invention further provides, in one form thereof, a fan having a plurality of rotating blades. A motor is supplied to rotate the blades. A source of illumination is secured to the outer periphery of at least one of the rotating blades.

The invention still further provides, in one form thereof, a fan having a plurality of rotating blades, in which each of the rotating blades has a radially outer periphery. A motor rotates the blades and is encased in a housing. A plurality of neon tubes is secured to the outer periphery of at least one of the blades and provides illumination. In addition, another source of illumination is fixedly secured to the housing.

It is an object of the present invention to provide an illuminated fan which is both functional and decorative.

It is another object of the present invention to provide a fan having conspicuous blades that can be seen especially in dark rooms to decrease the possibility of injury due to unintentional contact with the moving blades.

A still further object of the present invention is to provide a fan which can both circulate air and provide a soft and indirect illumination.

BRIEF DESCRIPTION OF THE DRAWINGS

The above-mentioned and other features and objects of this invention and the manner of attaining them will be more apparent and the invention itself will be better understood by reference to the following description of an embodiment of the invention taken in conjunction with the accompanying drawings, wherein.

Corresponding reference characters indicate corresponding parts throughout the several views of the drawings.

The exemplifications set out herein illustrates a preferred embodiment of the invention, in one form thereof, and such exemplification is not to be construed as limiting the scope of the disclosure or the scope of the invention is any manner.

DETAILED DESCRIPTION

Figure 1:
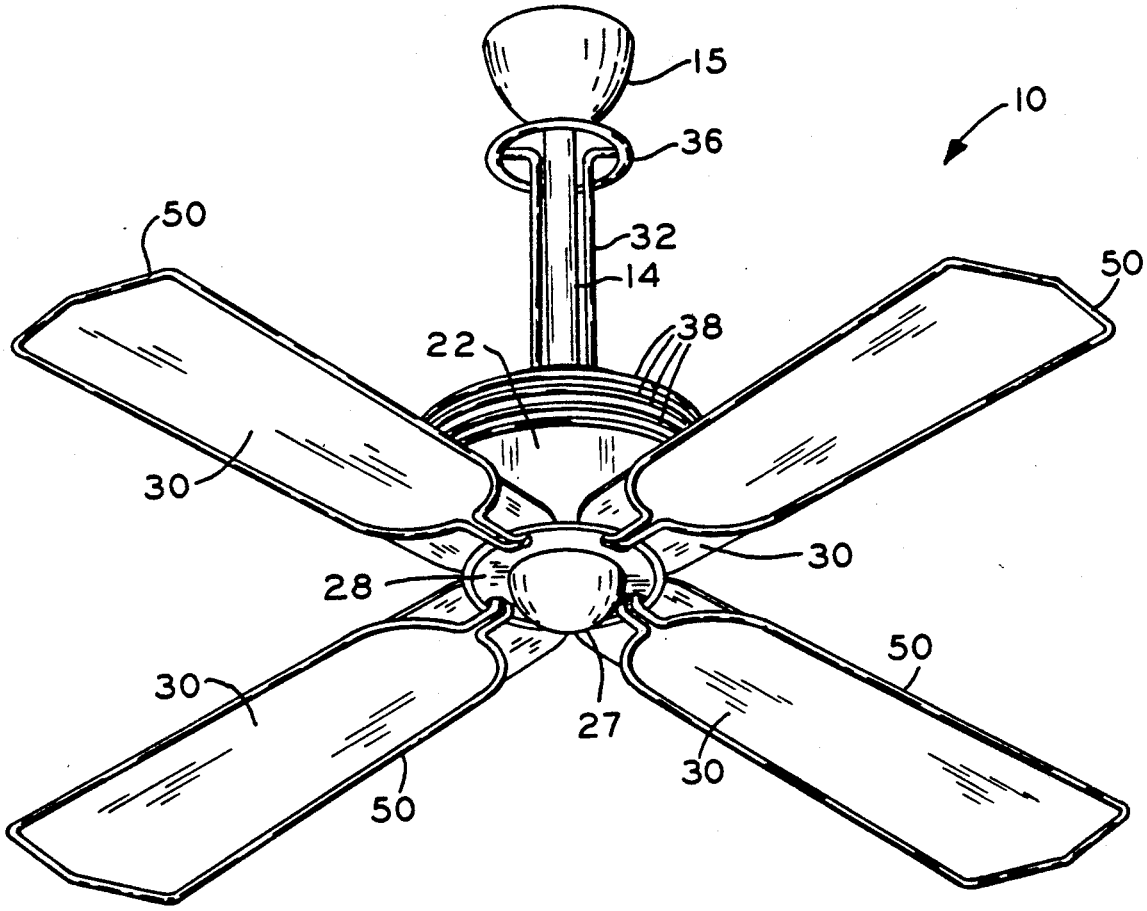
FIG. 1 is a perspective view of a ceiling fan equipped with neon lights.
Figure 2:
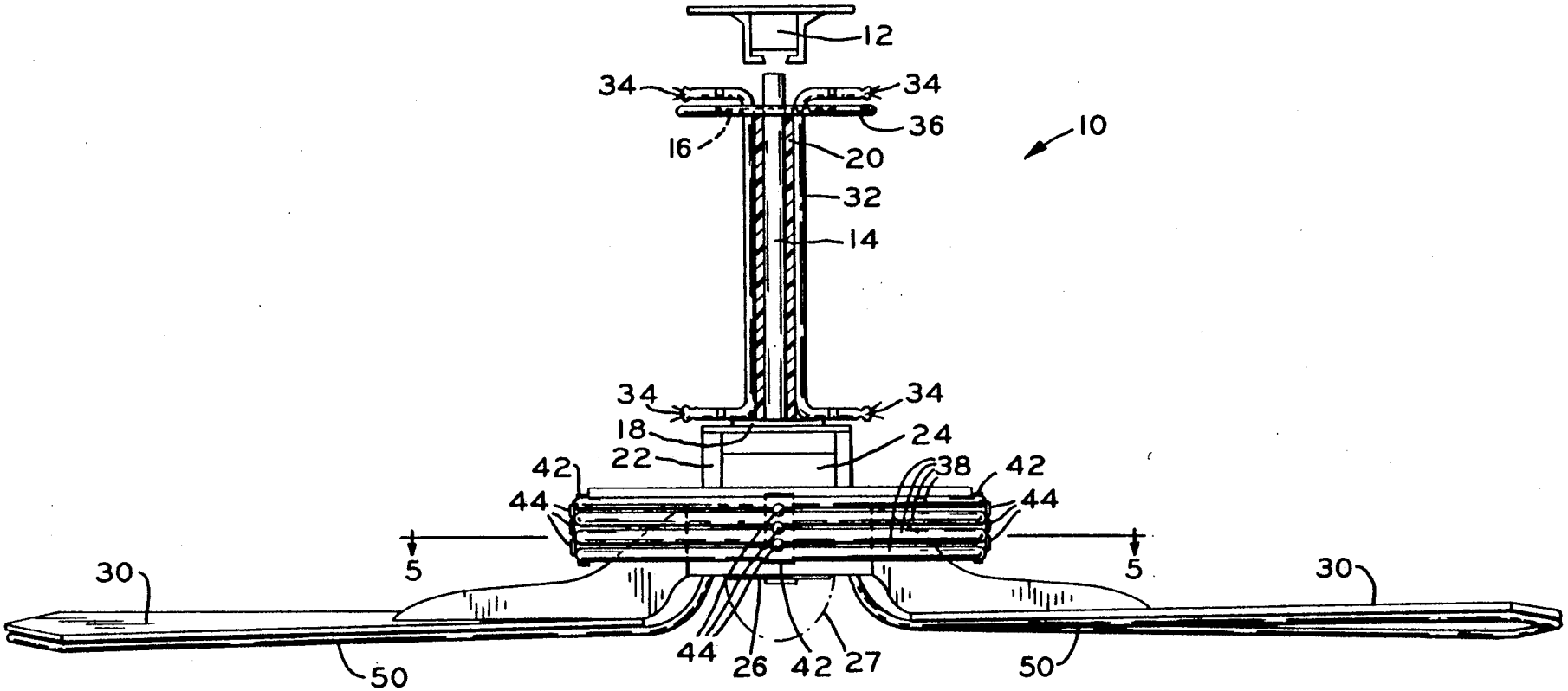
FIG. 2 is a cross-sectional view of the neon ceiling fan of FIG. 1.

Referring to FIGS. 1 and 2, there is shown a neon ceiling fan unit 10 having a support structure comprising a mounting box 12 secured to the ceiling (not shown) and a depending tubular support conduit 14. A protective dome 15 encases mounting box 12. Although not shown in the drawing, the mounting is a conventional swivel mount which allows the entire fan unit 10 to hang level regardless of mounting box alignment and further allows fan unit 10 to gimbal should an imbalance occur. As seen in FIG. 2, rosette 16 is located beneath mounting box 12 and generally comprises an acrylic disk. Tubular support conduit 14, which may be a metal tube, extends downwardly from mounting box 12 through rosette 16 to mounting flange 18. Flange 18 is a threaded metal disk and provides a rim for attaching the fan to the support structure. A transparent acrylic stanchion tube 20 supports rosette 16 and further encircles and insulates support conduit 14.

Figure 3:
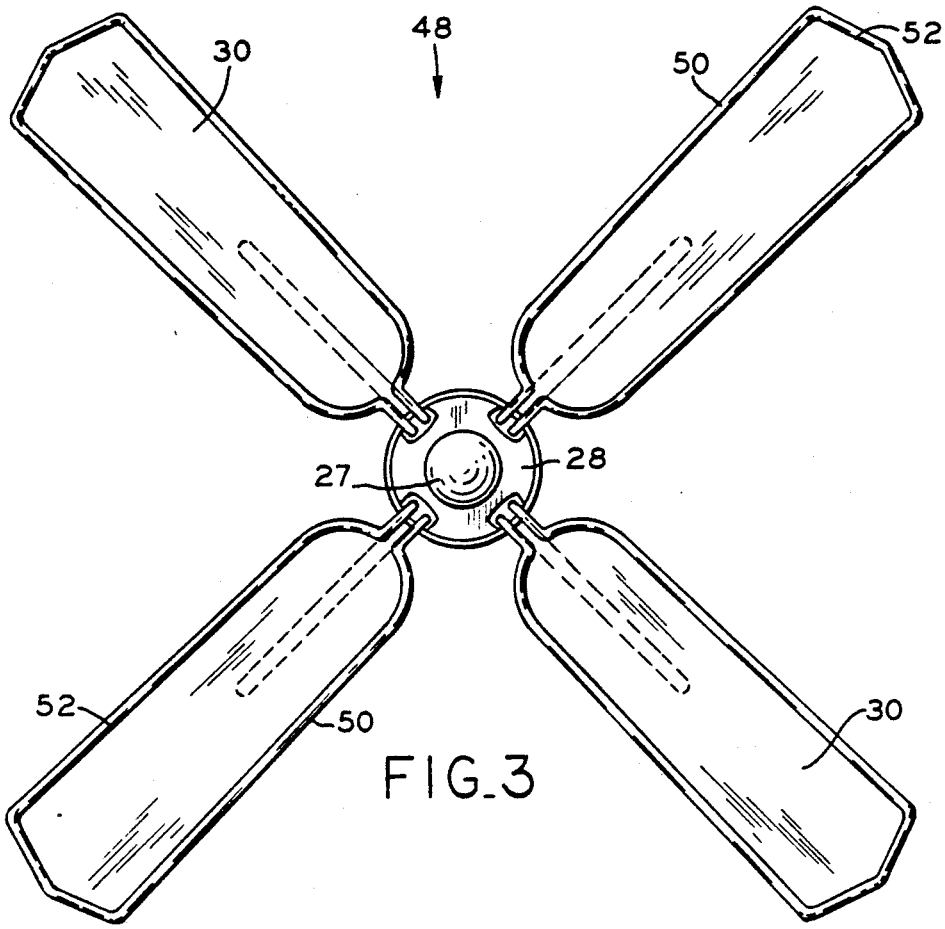
FIG. 3 is a bottom view of the neon ceiling fan of FIG. 1.

Referring now to the fan itself as illustrated in FIG. 2, there is shown a hat assembly 22 housing a motor 24 such as a reversible variable speed motor, a portion of which is mounted for rotation about a vertical axis. A drive hub 26 is clamped to the motor shaft (not shown) and is fastened to acrylic hub assembly 28. Drive hub 26 is encased by protective dome 27. As shown in FIG. 3, transparent acrylic fan blades 30 are secured to hub assembly 28 by an adhesive as well as a mechanical fastener.

In accordance with the present invention, there are shown neon riser tubes 32 supported by stanchion tube 20 and having electrodes 34 on each end thereof for energizing tubes 32. Rosette 16 protects and insulates neon tubes 32. A rosette neon tube 36 encircles rosette 16 and provides a decorative outline thereof.

Figure 4:
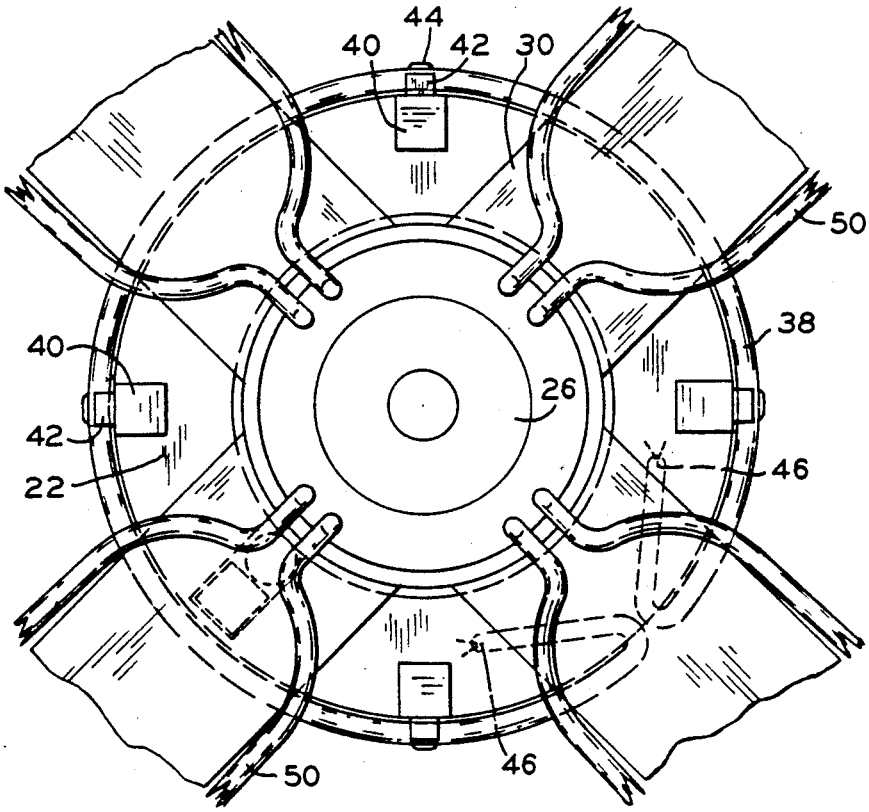
FIG. 4 is an enlarged view of the hub assembly of FIG. 3.
Figure 5:
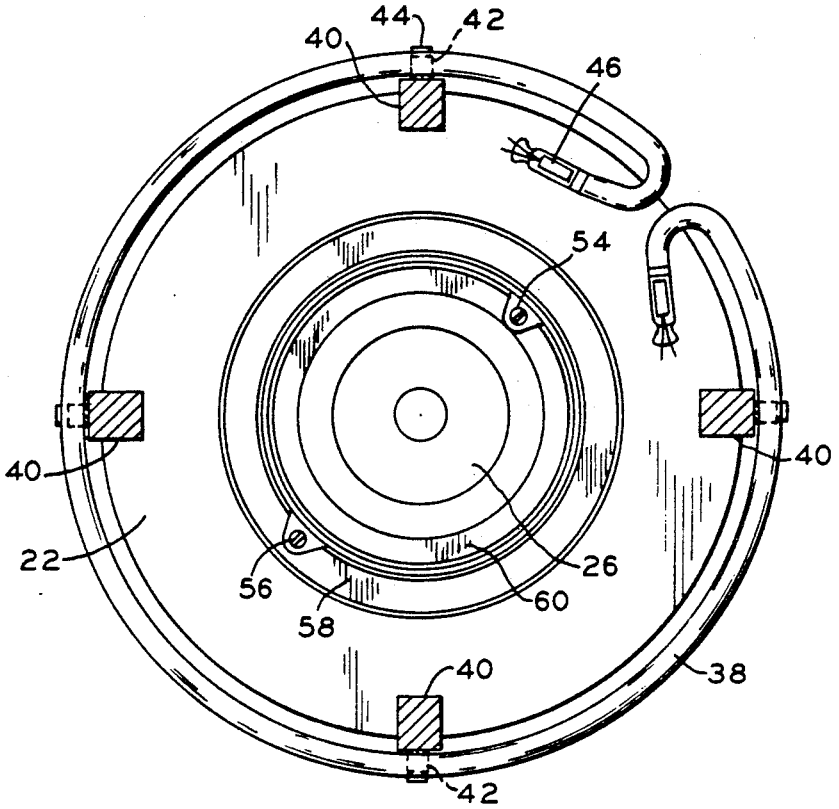
FIG. 5 is an enlarged cross-sectional view of the neon ceiling fan of FIG. 2 taken along line 5—5 thereof.
Figure 6:
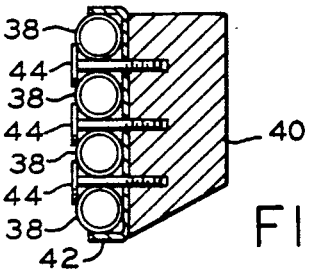
FIG. 6 is an enlarged view of the neon tube support retainer system.

Four ring-shaped neon tubes 38 are supported by hat assembly 22 and provide a decorative neon outline of motor 24. As seen in FIGS. 4, 5 and 6, neon rings 38 are supported by a plurality of neon tube supports 40. Rings 38 are attached to hat assembly 22 by neon tube support retainer clips 42 and nylon retainer screws 44. Each neon ring 38 has an electrode 46 on each end of the tube for energizing the tube.

Figure 7:
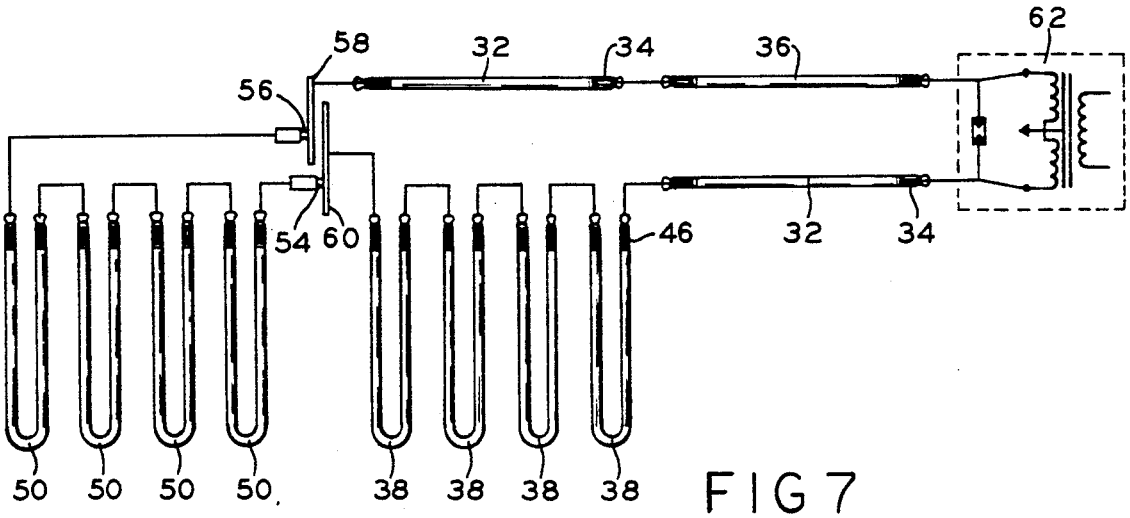
FIG. 7 is a schematic view of the electrical system of the neon ceiling fan of FIG. 1.

A rotating neon blade assembly is shown in FIG. 3 in which a neon blade tube 50 is provided around the peripheral portion 52 of each fan blade 30. As best shown in FIG. 4, neon tubes 50 are bent through openings in hub assembly 28 and are electrically connected together in series as schematically illustrated in FIG. 7. In order to provide continuous electrical energy to the rotating assembly, a brush and slip ring assembly is utilized to provide constant electrical contact between the stationary and rotating parts. It is possible to vary the energization rate to the neon tubes to create special effects. As seen in FIG. 5, hub assembly 28 includes an inner brush 54 and an outer brush 56. As hub assembly 28 rotates, inner brush 54 makes constant sliding contact with an inner pancake style slip ring 60, and outer brush 56 makes sliding contact with an outer slip ring 58 to provide continuous electrical contact to blade assembly 48 through brushes 54 and 56. As shown in FIG. 7, a neon riser tube 32 and a neon ring 38 are electrically connected to slip rings 58 and 60, respectively, to complete the series circuit.

In this manner, all of the aforementioned neon tubes are connected in series to high voltage power supply 62 for providing both stationary and rotating illumination to fan unit 10. Although neon is a suitable source of illumination, other sources of illumination may be used such as small incandescent lights or other such suitable light sources.

When the neon tubes are energized in a dark room, the only visible parts are the rotating neon tubes outlining the perimeter of each blade and the stationary neon tubes surrounding the motor and supporting structure to provide an aesthetically pleasing view. A combination of differently colored neon lights may be used to create varying decorative effects.

Although the present invention describes an illuminated ceiling mounted fan, it is understood that this invention also pertains to stand mounted fans which are simply plugged in a wall socket and set on the floor where desired.

While this invention has been described as having a preferred design, it will be understood that it is capable of further modification. This application is therefore intended to cover any variations, uses, or adaptations of the invention following the general principles thereof and including such departure from the present disclosure as come within known or customary practice in the art to which this invention pertains.

What is claimed is:

1. A fan comprising:

a plurality of rotating blades;

drive means for rotating said blades; and illuminating means for providing illumination, said illuminating means secured to at least one of said plurality of rotating blades for rotation therewith, each of said plurality of rotating blades including a radially outer periphery, and said illuminating means surrounding said outer periphery.

2. The fan according to claim 1 wherein said illuminating means comprises a plurality of neon tubes corresponding substantially in shape to said outer periphery.

3. A fan comprising:

a plurality of rotating blades;

drive means for rotating said blades;

illuminating means for providing illumination, said illuminating means secured to at least one of said plurality of rotating blades for rotation therewith; and a housing surrounding said drive means and a stationary illuminating means for providing illumination secured to said housing.

4. A fan comprising:

a plurality of rotating blades, each of said plurality of rotating blades including a radially outer periphery;

drive means for rotating said blades; and illuminating means for providing illumination, said illumination means being secured to said outer periphery of at least one of said plurality of rotating blades for rotation therewith.

5. The fan according to claim 4 wherein said illuminating means is adapted to be energized by a source of electrical power.

6. The fan according to claim 5 wherein said illuminating means comprises a plurality of neon tubes corresponding substantially in shape to said outer periphery.

7. The fan according to claim 4 further including mounting means for mounting the fan to a ceiling.

8. The fan according to claim 4 wherein said drive means comprises a motor having a rotating shaft, said plurality of rotating blades being secured to said shaft and extending radially outwardly therefrom.

9. A fan comprising:

a plurality of rotating blades, each of said plurality of rotating blades including a radially outer periphery;

drive means for rotating said blades;

a housing surrounding said drive means;

first illuminating means for providing illumination, said first illumination means being secured to said outer periphery of at least one of said plurality of said rotating blades for rotation therewith; and second illuminating means for providing illumination, said second illuminating means being fixedly secured to said housing.

10. The fan according to claim 9 wherein said first illuminating means and said second illuminating means are each adapted to be energized by a source of electrical power.

11. The fan according to claim 10 wherein said first illuminating means comprises a plurality of neon tubes corresponding substantially in shape to said outer periphery.

12. The fan according to claim 9 and further including mounting means for mounting the fan to a ceiling.

* * * * *